US010808515B1

(12) United States Patent
Sierra et al.

(10) Patent No.: US 10,808,515 B1
(45) Date of Patent: Oct. 20, 2020

(54) PROPPED FRACTURE GEOMETRY WITH CONTINUOUS FLOW

(71) Applicant: Halliburton Energy Services, Inc., Houston, TX (US)

(72) Inventors: Leopoldo Sierra, Houston, TX (US); Larry Steven Eoff, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/436,536

(22) Filed: Jun. 10, 2019

(51) Int. Cl.
*E21B 43/267* (2006.01)
*E21B 43/12* (2006.01)

(52) U.S. Cl.
CPC ..... *E21B 43/267* (2013.01); *E21B 43/13* (2020.05)

(58) Field of Classification Search
CPC ..... E21B 43/267; E21B 43/13; E21B 43/46
See application file for complete search history.

(56) References Cited

U.S. PATENT DOCUMENTS 6,860,328 B2 3/2005 Gonzalez et al.
7,472,751 B2 1/2009 Brannon et al.
2004/0206497 A1* 10/2004 Gonzalez ..... E21B 43/267 166/271
2008/0149329 A1* 6/2008 Cooper ..... E21B 43/267 166/250.01
2011/0036571 A1 2/2011 Vitalievich et al.
2011/0083849 A1 4/2011 Medvedev et al.
2014/0048262 A1* 2/2014 Worley ..... E21B 43/267 166/280.1
2018/0016489 A1 1/2018 Suzart et al.
2018/0051203 A1 2/2018 Nguyen et al.
2018/0230363 A1 8/2018 McDaniel
2019/0300778 A1* 10/2019 Nguyen ..... E21B 43/267

OTHER PUBLICATIONS

Foreign Communication from Related Application—International Search Report and Written Opinion of the Internationa Searching Authority, International Application No. PCT/US2020/016388, dated May 28, 2020, 10 pages.

* cited by examiner

*Primary Examiner* — Silvana C Runyan
(74) *Attorney, Agent, or Firm* — Conley Rose, P.C.; Rodney B. Carroll

(57) ABSTRACT

Method of arranging proppant in a fracture of a subterranean formation are disclosed. The methods can include (a) introducing a first fluid blend through a wellbore and into the fracture to form a first proppant bank in the fracture, and (b) introducing a second fluid blend through the wellbore and into the fracture to form a second proppant bank in the fracture, wherein a viscosity of the first fluid blend is less than a viscosity of the second fluid blend. The flow of the fluids can be alternated or switched between a lower viscosity fluid blend(s) and a higher viscosity fluid blend(s), without stopping a flow of fluid to the fracture.

18 Claims, 3 Drawing Sheets

PROPPED FRACTURE GEOMETRY WITH CONTINUOUS FLOW

TECHNICAL FIELD

This present disclosure relates generally to hydraulic fracturing to stimulate hydrocarbon recovery from a subterranean formation and to using proppants to hold fractures open.

BACKGROUND

Hydraulic fracturing stimulates the production of hydrocarbons from a subterranean formation. For example, unconventional reservoirs contained in shale rock may not be viable plays without fracturing, and fracturing techniques may be used to stimulate hydrocarbon recovery. The fracturing process typically involves injecting a pad fluid down a perforated wellbore at sufficient rate and pressure to fracture the subterranean formation, thereby creating or enhancing one or more fractures in the rock of the subterranean formation. The fracture functions as a conduit for hydrocarbons to flow out of the subterranean formation and into the wellbore, at which point the hydrocarbons can flow through the wellbore to the surface. However, if the fracturing pressure is released from the fracture, the fracture may close under the opposing forces of the subterranean formation. Thus, after the fracture is created, and without releasing the fracturing pressure on the fracture, proppant is pumped into the wellbore and into the fracture in order to hold the fracture open. After placing the proppant in the fracture, the fracturing pressure is released, and the proppant keeps the fracture open against the forces exerted by the subterranean formation. Proppant remains in the fracture, and other fluid(s) is flowed back to the surface and/or leaks off into the subterranean formation. The proppant-filled fracture functions as a highly conductive channel which facilitates the flow of hydrocarbons from the subterranean formation into the wellbore. Generally, the more proppant that can be pumped into a fracture, the more effective the conductive channel will be, and the higher the flow of hydrocarbons into the wellbore can be.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Viscosity values disclosed herein can be measured in accordance with ASTM D455.

The "average distance" for proppant in a proppant bank as used herein is the average of all proppant particle distances in a proppant bank from the wellbore. A particular point of the wellbore can be used as a reference point for the average distance, e.g., a perforation or a center point of the wellbore.

Disclosed herein are methods for arranging proppant in a fracture of a subterranean formation that can better place proppant along the fracture length and height. The methods disclosed herein are particularly useful for unconventional reservoirs, e.g., in subterranean formations containing shale. The methods disclosed herein enable customizing the proppant geometry in the fracture, increasing effective fracture-reservoir contact, and increasing productivity of the reservoir.

Figure 1:
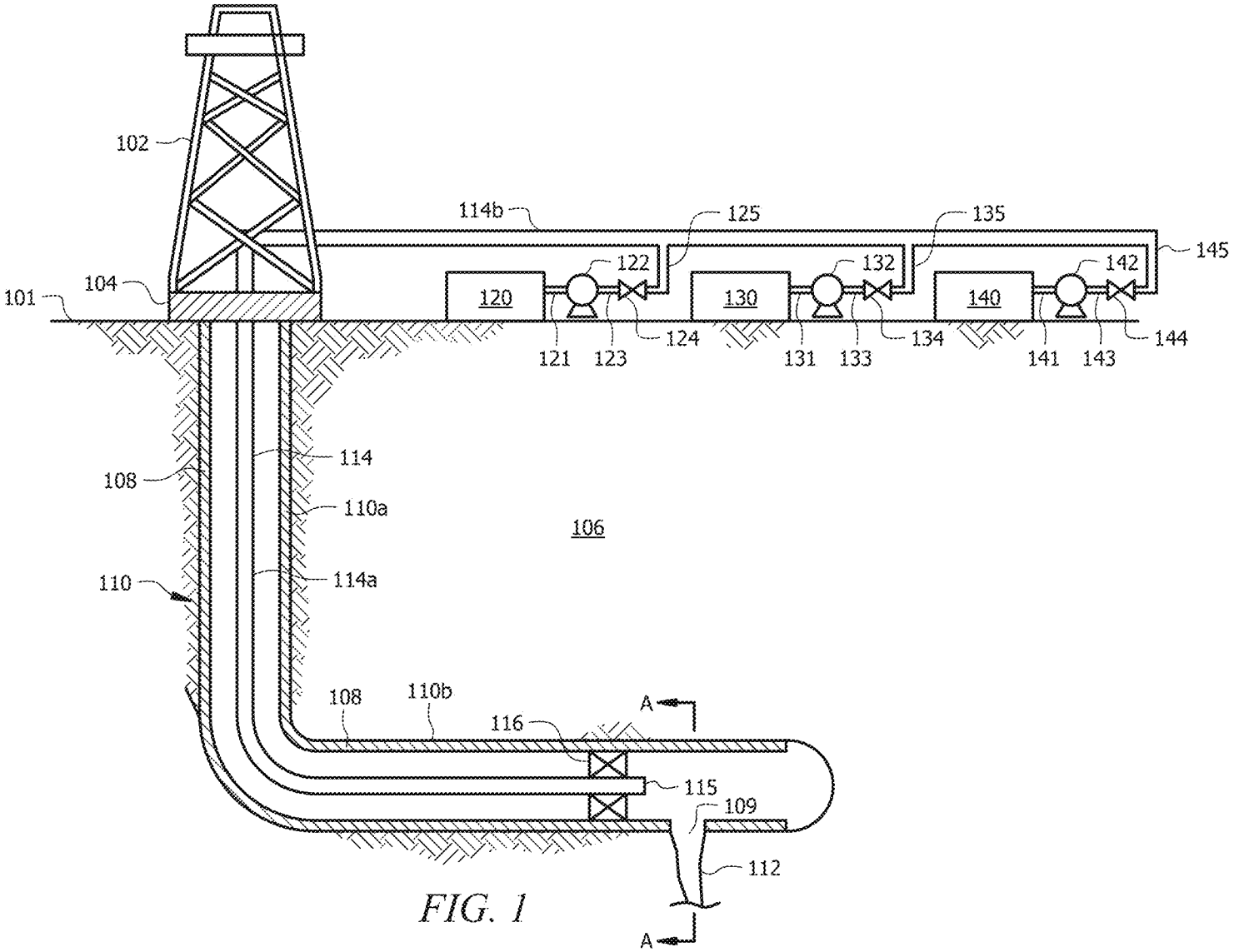
FIG. 1 is a cross-sectional view of a subterranean formation having a fracture formed therein.
Figure 2:
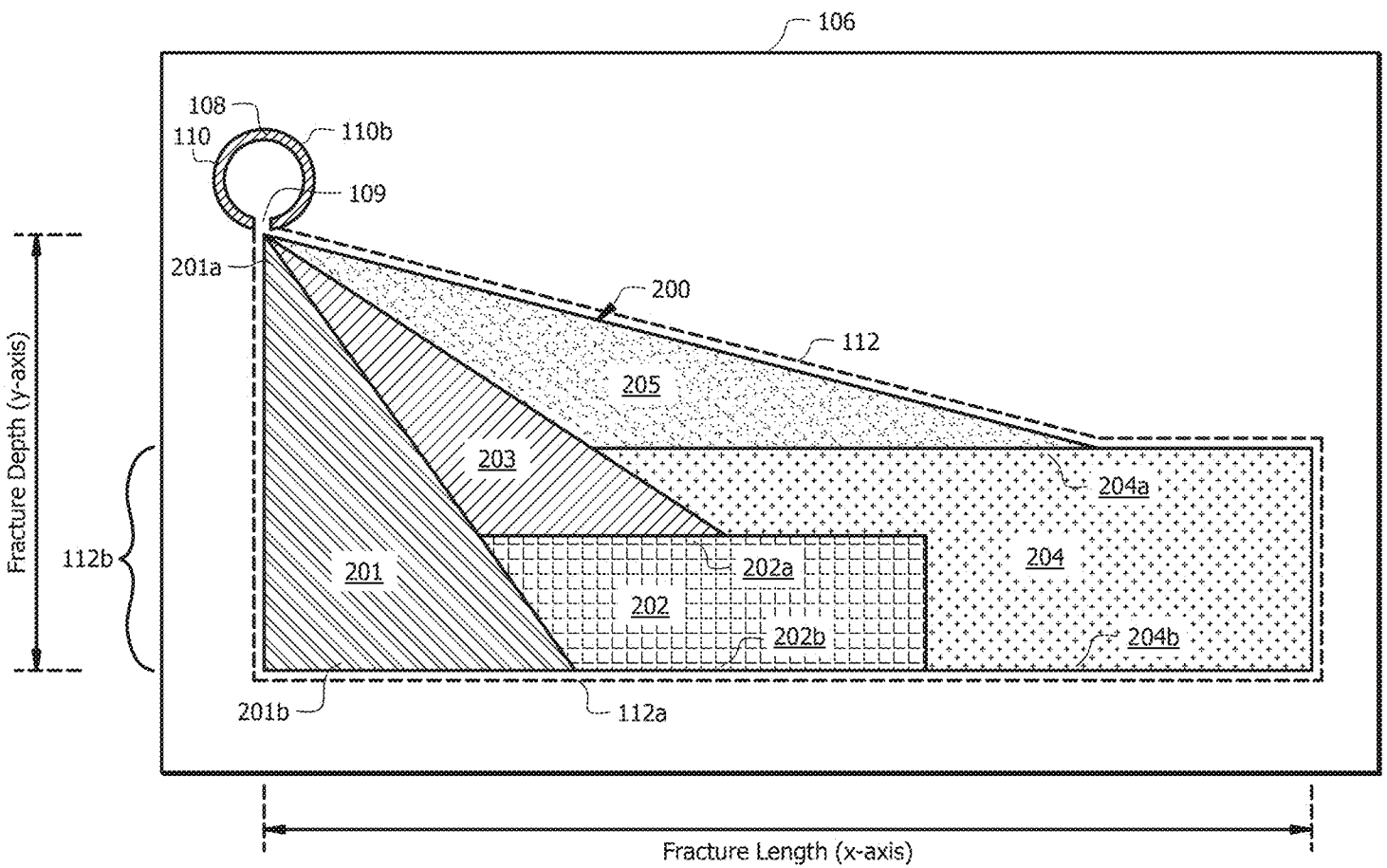
FIG. 2 is a cross-section view of the fracture having proppant banks placed therein, taken along sight line A-A of FIG. 1.

FIG. 1 and FIG. 2 are used to describe the methods for arranging proppant in a fracture 112 of a subterranean formation 106.

In FIG. 1, it can be seen that a wellbore 110 was formed in the subterranean formation 106. The wellbore 110 has a vertical section 110*a* and a horizontal section 110*b*. The term "vertical section" as used herein may refer to a section of the wellbore 110 that is more vertically oriented than the horizontal section 110*b*, and the term "horizontal section" as used herein may refer to a section of the wellbore 110 that is more horizontally oriented than the vertical section 110*a*. Thus, the vertical section 110*a* may be exactly vertical or may extend at an angle with respect to vertical that is +/−89°, and similarly, the horizontal section 110*b* may be exactly horizontal or may extend at an angle with respect to horizontal that is +/−89°.

The wellbore 110 contains a casing 108 that is cemented onto the inner wall of the wellbore 110, and a perforation 109 was formed in the casing 108 in the desired location for the fracture 112 according to any technique known in the art with the aid of this disclosure. A conduit 114 was then placed into the wellbore 110 such that portion 114*a* of the conduit 114 is in the wellbore 110 and end 115 of the conduit is near the perforation 109. A seal 116 was placed annularly between the casing 108 and the conduit 114 to create a closed zone for fracturing the subterranean formation 106 via the perforation 109 in the casing 108. A fracturing fluid (also referred to herein as a "pad fluid") was then introduced into the wellbore 110 at a predetermined rate and pressure, to initiate the fracture 112 in the subterranean formation 106.

FIG. 1 shows additional equipment that is used to accomplish the method of the present disclosure. The derrick 102 and the rig floor 104 remain at the surface 101 of the earth. The conduit 114 has a portion 114*b* that extends out of the wellbore 110 at the surface 101 so as to inter-connect to various fluid sources 120, 130, and 140. The fluid sources include a water source 120, a viscosifying agent source 130, and a proppant source 140.

The water source 120 is coupled to the portion 114*b* of conduit 114 by conduit 121, pump 122, conduit 123, valve 124, and conduit 125. The water source 120 can be embodied as a tank, reservoir, silo, pipeline, pit, or a combination thereof, that contain(s) the water. The water can be of any purity suitable (e.g., fresh water, brine, salt water, or a combination thereof) for use for fracturing and building proppant banks in the fracture 112 according to this disclosure. In some embodiments, the water is primarily fresh water. It is contemplated that multiple types of water described herein can be obtained from any combination of tank, reservoir, silo, pipeline, or pit (e.g., a brine pit and a tank of salt water, both being coupled to conduit 114), and that the multiple types of water collectively form the water source 120. The pump 122 can be a water pump capable of pumping the water into the conduit 114 under the pressures suitable for fracturing and building proppant banks. The valve 124 can be configured to adjust a flow rate of the water through conduits 125 and 114 so that a particular concentration of water is present in the fluid blend being pumped into the subterranean formation 106. In embodiments, the valve 124 can be from 1% to 100% open in order to accomplish the disclosed methods. In some embodiments, a flow rate of water can be constant, varied, or a combination of constant and varied.

The viscosifying agent source 130 is coupled to the portion 114*b* of conduit 114 by conduit 131, pump 132, conduit 133, valve 134, and conduit 135. Viscosifying agent source 130 can be embodied as a tank, container, or otherwise any vessel suitable for containing the viscosifying agent. The viscosifying agent can be any of those disclosed herein for use for fracturing and building proppant banks in the fracture 112 according to this disclosure. It is contemplated that multiple types and/or species viscosifying agents described herein can be obtained from any combination of tank, reservoir, silo, pipeline, or pit (e.g., a first viscosifying agent is in a first tank, and a second viscosifying agent is in a second tank, both being coupled to the conduit 114), and that the multiple types and/or species of viscosifying agents collectively form the viscosifying agent source 130. The pump 132 can be a liquid pump capable of pumping the viscosifying agent(s) into the conduit 114 under the pressures suitable for fracturing and building proppant banks. The valve 134 can be configured to adjust a flow rate of the viscosifying agent through conduits 135 and 114 so that a particular concentration of viscosifying agent is present in the fluid being pumped into the subterranean formation 106. In embodiments, the valve 134 can be from 1% to 100% open in order to accomplish the disclosed methods. For example, for the lower viscosity fluid blends disclosed herein, the percentage open that the valve 134 is can be less than the percentage open that the valve is for the higher viscosity fluid blends disclosed herein. In some embodiments, a flow rate of viscosifying agent can be constant, varied, or both constant and varied.

The proppant source 140 is coupled to the portion 114*b* of conduit 114 by conduit 141, pump 142, conduit 143, valve 144, and conduit 145. Proppant source 140 can be embodied as a funnel, tank, reservoir, silo, pit, or a combination thereof, that contain(s) the proppant. The proppant is particulate solids that can be of any type, size, and shape (e.g., spherical, oblong) suitable for fracturing and creating/building proppant banks in the fracture 112 according to this disclosure. The pump 142 can be a solids pump capable of pumping proppant into the conduit 114 under the pressures suitable for fracturing and building proppant banks. The valve 144 can be configured to adjust a flow rate of the proppant through conduits 145 and 114 so that a particular concentration of proppant is present in the fluid being pumped into the subterranean formation 106. In embodiments, the valve 144 can be from 1% to 100% open in order to accomplish the disclosed methods. In some embodiments, a flow rate of the proppant can be constant, varied, or both constant and varied. The illustration in FIG. 1 of the coupling of the proppant source 140 to the conduit 114 is by example only, and it is to be understood that other mechanisms for delivering proppant (i.e., solid particles) into the conduit 114, such as a funnel for a proppant source placed above the conduit 114 that introduces proppant into the conduit 114 by gravity, are within the scope of this disclosure.

In some embodiments, fracturing fluid blends (also referred to herein as proppant fluid blends or more simply "fluid blends") of the type described herein may be prepared by feeding the components of the fluid blend to a common flowline and/or a common vessel such as a blender, where the components are combined and mixed to form a wellbore servicing fluid (e.g., a fracturing fluid) that is pumped into the wellbore. For example, conduits 125, 135, and 145 may flow into a common flowline and/or blender, where the components are thoroughly mixed and a resultant wellbore servicing fluid flow (e.g., from a blender outlet) through one or more pumps and into conduit 114*b* for further placement into fracture 112 via conduit 114*a*.

The pumps 122, 132, and 142 operate in conjunction with the valves 124, 134, and 144 to supply a particular concentration of each component (water, viscosifying agent, proppant) to the conduit 114 (e.g., via a blender) so as to create a lower viscosity fluid blend or a higher viscosity fluid blend described herein. The disclosure contemplates that the pumps 122, 132, and 142 can operate continuously and one or more of the valves 124, 134, and 144 can be actuated in real-time (e.g., manually via computer control, automatically via computer control, manually via human actuation of the valve, or a combination thereof) to a different percentage open in order to switch fluid blends in real-time without stopping a flow of fluid to the fracture 112. That is, the flow of fluid in conduit into the fracture 112 can be continuous while one fluid blend can be switched to another fluid blend in real-time via actuation of one or more valves 124, 134, and 144. Put another way, in embodiments, the flow of fluid is not stopped when changing the fluid blends.

Generally, the fluid blends disclosed herein are used to build proppant banks in the fracture 112. The fluid blends disclosed herein can include fluid blends that have a relatively lower viscosity and fluid blends that have a relatively higher viscosity in comparison to each other. The lower viscosity fluid blends can have a viscosity that is between about 1 cp and about 5 cp at standard temperature and pressure; alternatively, between about 1 cp and about 4 cp; alternatively, between about 1 cp and about 3 cp. In some embodiments, the lower viscosity fluid blends have a maximum viscosity of 5 cp to promote settling of the proppant around the wellbore 110. The higher viscosity fluid blends can have a viscosity that is between about 5 cp and about 200 cp at standard temperature and pressure; alternatively, between about 6 cp and about 200 cp; alternatively, between about 7 cp and about 200 cp; alternatively, between about 8 cp and about 200 cp; alternatively, between about 9 cp and about 200 cp; alternatively, between about 10 cp and about 200 cp; alternatively, between about 15 cp and about 200 cp; alternatively, between about 20 cp and about 200 cp; alternatively, between about 25 cp and about 200 cp; alternatively, between about 50 cp and about 200 cp; alternatively, between about 75 cp and about 200 cp; alternatively, between about 100 cp and about 200 cp; alternatively, between about 150 cp and about 200 cp. The viscosity of the higher viscosity fluid blends can be between 2 to 200, 3 to 150, 4 to 100, or 5 to 100 times the viscosity of the lower viscosity fluid blends. Put another way, a ratio of the viscosity of the higher viscosity fluid blends to the viscosity of the lower viscosity fluid blends can be in a range of 2:1 to 200:1; alternatively, 3:1 to 150:1; alternatively, 4:1 to 100:1; alternatively, 5:1 to 100:1. The higher viscosity of the higher viscosity fluid blends promotes carrying of the proppant farther into the fracture 112. In general, the higher viscosity fluid blends have a higher carrying capacity for the proppant than the lower viscosity fluid blends. That is, the proppant can stay suspended longer in the higher viscosity fluid blends than in the lower viscosity blends under conditions existing in the fracture 112. Without being limited by theory, it is believed that proppant can be pumped farther away from the wellbore 110 into the fracture 112 when contained in the higher viscosity fluid blends than when contained in the lower viscosity fluid blends of this disclosure. Moreover, based on the examples discussed below, it is believed that alternating between higher and lower viscosity fluid blends can build a collection of proppant banks in a fracture 112 that is deeper and laterally further away from the wellbore 110 than would otherwise be achieved without using the methods disclosed herein.

Each of the fluid blends described herein can include water, one or more viscosifying agents, and one or more proppants. Generally, the higher viscosity fluid blends can have a concentration of viscosifying agents and/or proppant that is greater than a concentration of viscosifying agents and/or proppant in the lower viscosity fluid blends. In embodiments, the viscosifying agent of a lower viscosity fluid blend can be the same viscosifying agent of the higher viscosity blend, and the difference between the blends is the higher viscosity fluid blend has a concentration of the viscosifying agent that is greater than the concentration of the viscosifying agent in the lower viscosity fluid blend. In some embodiments, the method can switch from pumping a lower viscosity fluid blend to pumping a higher viscosity fluid blend into the conduit 114, wellbore 110, and fracture 112 by increasing the amount (concentration) of the viscosifying agent pumped into the conduit 114, wellbore 110, and fracture 112. Similarly, the method can switch from pumping a higher viscosity fluid blend to pumping a lower viscosity fluid blend into the conduit 114, wellbore 110, and fracture 112 by decreasing the amount (concentration) of the viscosifying agent pumped into the conduit 114, wellbore 110, and fracture 112.

The water in each of the fluid blends can be fresh water, salt water, brine, or a combination thereof. The water can be sourced from any known water source, and in some embodiments, the water is primarily fresh water.

The viscosifying agents disclosed herein can be used to decrease or increase the ability of a particular fluid blend to suspend and carry the proppant into the fracture 112. Viscosifying agents are sometimes used for other purposes, such as matrix diversion and conformance control, and can also be referred to in the art as a friction reducer, viscosifier, thickener, gelling agent, or suspending agent. In embodiments, the viscosifying agent(s) can be an emulsion, e.g., an oil-external emulsion. In additional or alternative embodiments, the viscosifying agent(s) in each of the fluid blends can include or be a naturally occurring polymer (e.g., a polysaccharide), a derivative of a naturally occurring polymer, or a synthetic polymer (e.g. a polyacrylamide). In some embodiments, the viscosifying agent can be water-soluble. In embodiments, the viscosifying agent can have an average molecular weight in the range of from about 50,000 Da to 20,000,000 Da, about 100,000 Da to about 4,000,000 Da, or about 2,000,000 Da to about 3,000,000 Da. The viscosifying agent should be present in a fluid blend in a form and in a concentration that is sufficient to impart the desired viscosity to the fluid blend. In embodiments, the concentration of viscosifying agent(s) in the fluid blends can be from about 0.01 wt % to about 5 wt % based on the weight of the continuous (i.e., liquid) phase in the fluid; alternatively, from about 0.0001 vol % to about 0.01 vol % based on the volume of the continuous phase in the fluid.

In some embodiments, it is contemplated that presence of the viscosifying agent in the fluid blends described herein can provide adequate viscosity for carrying the proppant a desired distance (depth and/or length), without the use of cross-linking agents that would further increase the viscosity of the fluid blends by cross-linking the polymers present as the viscosifying agent in the fluid blends.

The proppant is also known in the art as a "sustaining agent." The proppant is in the form of a solid particulate, which can be suspended in the fluid blends, carried downhole, and deposited in the fracture 112 to form a proppant pack 200, formed by the collective group of proppant banks 201, 202, 203, 204, and 205 in FIG. 2. The proppant pack 200 props the fracture 112 in an open position while allowing fluids (e.g., hydrocarbons in the case of production of fluids from the subterranean formation 106) to flow between the solid particulates that define the boundaries of the pack 200. The proppant pack 200 in the fracture 112 provides a higher-permeability flow path for the hydrocarbons to reach the wellbore 110 compared to the permeability of the surrounding un-fractured subterranean formation 106. This higher-permeability flow path increases hydrocarbon production from the subterranean formation 106.

The proppant can be selected based on the characteristics of size, crush strength, and solid stability in the types of fluids that are encountered or used in wells. A proppant should not melt, dissolve, or otherwise degrade from the solid state under the downhole conditions and conditions in the fracture 112. Appropriate sizes of particulate for use as a proppant are typically in the range from about 2 to about 100 U.S. Standard Mesh. A typical proppant is sand-sized, which geologically is defined as having a largest dimension ranging from about 0.06 millimeters (mm) up to about 2 millimeters (mm). The proppant should be stable over time and not dissolve in fluids commonly encountered in a well environment. The proppant can have a sufficient compressive or crush resistance to prop the fracture 112 open without being deformed or crushed by the closure forces of the fracture 112 in the subterranean formation 106. For example, for a proppant material that crushes under closure stress in the fracture 112, can have an API crush strength of at least 5,000 psi closure stress based on 6% crush fines according to procedure API RP-56.

The proppant in each of the fluid blends can include sand, sintered bauxite, ground nut shells, ground fruit pits, glass (e.g., glass beads), plastics, ceramic materials, processed wood, composite materials, resin-coated particulates (e.g., resin-coated sand), or a combination thereof. The proppant in each of the fluid blends can also contain different sizes and shapes of the same type of proppant, different kinds of proppant, or different sizes and shapes of different types of proppant. Generally, when the goal of depositing a proppant bank is to place proppant as deep in the fracture 112 as possible, a proppant having a density greater than the liquid density of the fluid blend is desirable, so that the proppant is urged by its own density to the lowest point available in the fracture 112. In such a case, lighter proppants such as ground nut shells and fruit pits may not be suitable for use as the proppant, while sand and similar density materials may be preferred. The concentration of proppant in the fluid blends can be from about 0.03 kg/l to about 12 kg/l, based on liters of the liquid phase.

Referring now to FIG. 2, a cross-sectional view of the fracture 112 and the subterranean formation 106 is taken in the direction of sight lines A-A of FIG. 1. An x-y-z coordinate system is also provided by FIG. 2, wherein distances along the x-axis indicate a fracture length, distances along the y-axis indicate a fracture depth, and the z-axis is coaxial with a central axis of the horizontal portion 110*b* of the wellbore. The boundary of the fracture 112 is shown by dashed lines, and the shape of the fracture 112 formed by the boundary is drawn for purposes of description and is not to be limited to the shape seen in FIG. 2. In FIG. 2, the casing 108 can be seen in the horizontal section 110*b* of the wellbore 110, and the fracture 112 can be seen as located at the perforation 109 in the casing 108 of the wellbore 110. The perforation 109 can be located at any location of the casing 108 where the fracture 112 (or fractures) has been initiated.

FIG. 2 shows that proppant pack 200 is made of five proppant banks 201, 202, 203, 204, and 205. However, it is contemplated that a proppant pack made according to this disclosure can contain at least two proppant banks; alternatively, a plurality of proppant banks; or alternatively 2, 3, 4, 5, 6, 7, 8, 9, 10, 11, 12, 13, 14, 15, 16, 17, 18, 19, 20, or more proppant banks. The maximum number of proppant banks that can be formed by the disclosed methods may only limited by the volume of the fracture 112 and other practical considerations such as downhole operating pressures. For explanation only, FIG. 2 illustrates the proppant pack 200 has five proppant banks 201, 202, 203, 204, and 205, and any suitable number of proppant banks may be utilized in accordance with this disclosure.

The disclosed methods include introducing various fluid blends through the wellbore 110 (e.g., via a vertical section 110*a* or via a horizontal section 110*b*) and into the fracture 112 to form proppant banks (e.g., banks 201, 202, 203, 204, and 205) that form the proppant pack 200. The disclosed methods contemplate that the pattern for introducing the fluid blends switches, in real-time, from relatively lower viscosity fluid to relatively higher viscosity fluid and repeats this sequence until the desired number of proppant banks is formed or the fracture 112 cannot take any more proppant.

In the example of FIG. 2, the method includes alternating or switching between introducing a lower viscosity fluid blend and introducing a higher viscosity fluid blend by sequencing through a first fluid blend (e.g., relatively lower), a second fluid blend (e.g., relatively higher), a third fluid blend (e.g., relatively lower), a fourth fluid blend (e.g., relatively higher), and a fifth fluid blend (e.g., relatively lower). That is, by example, a first fluid blend can be introduced through the horizontal section 110*b* of the wellbore 110 and into the fracture 112 to form a first proppant bank 201 in the fracture 112, a second fluid blend can be introduced through the horizontal section 110*b* of the wellbore 110 and into the fracture 112 to form a second proppant bank 202 in the fracture 112, a third fluid blend can be introduced through the horizontal section 110*b* of the wellbore 110 and into the fracture 112 to form a third proppant bank 203 in the fracture 112, a fourth fluid blend can be introduced through the horizontal section 110*b* of the wellbore 110 and into the fracture 112 to form a fourth proppant bank 204 in the fracture 112, and a fifth fluid blend can be introduced through the horizontal section 110*b* of the wellbore 110 and into the fracture 112 to form a fifth proppant bank 205 in the fracture 112.

Additional fluid blends can be further used or fluid blends selected from the first through fifth described above can be further used, alternating between lower and higher viscosity fluid blends so as to increase the size of the proppant pack 200 (e.g., via increasing the size of any of proppant banks 201, 202, 203, 204, and 205; or by adding any number of additional proppant banks) in the fracture 112.

Other embodiments of the method can include switching, in real-time, a continuous flow of fluids through the wellbore 110 and into the fracture 112 between the first fluid blend and the second fluid blend, and building the proppant pack 200 in the fracture as a result of the switching. Switching can include switching from flowing the first fluid blend to flowing the second fluid blend, and repeating the switching 1, 2, 3, 4, 5, 6, 7, 8, 9, 10, 20, 30, 40, 50, 60, 70, 80, 90, 100, or more times. Switching can also include alternating between flowing the first fluid blend to flowing the second fluid blend until a desired amount of proppant has been placed into the fracture 112. In such embodiments, two fluid blends can be used for simplicity: one lower viscosity fluid blend and one higher viscosity fluid blend. In embodiments, both blends can use the same or different viscosifying agents in the viscosifying agent source 130, and the difference between the lower viscosity fluid blend and the higher viscosity fluid blend can be the concentration of the viscosifying agent in the respective blend. For example, the higher viscosity fluid blend can be achieved by actuating the valve 134 to a higher-percentage open than the percentage open that is used for the viscosifying agent when flowing the lower viscosity fluid blend into the conduit 114. Similarly, the lower viscosity fluid blend can be achieved by actuating the valve 134 to a lower-percentage open than the percentage open that is used for the viscosifying agent when flowing the higher viscosity fluid blend into the conduit 114. In additional embodiments, the lower percentage open of the valve 134 can be same each time the lower viscosity fluid is introduced into the fracture 112, and the higher percentage open can be the same each time the higher viscosity fluid is introduced into the fracture 112. In further embodiments and referring to FIG. 2, the first fluid blend (i.e., the lower viscosity blend) can be used to create the first proppant bank 201, the third proppant bank 203, and the fifth proppant bank 205; while, the second fluid blend (i.e., the higher viscosity blend) can be used to create the second proppant bank 202 and the fourth proppant bank 204.

The flow of any of the fluid blends, when introduced to the wellbore 110, can be constant, varied, or a combination of constant and varied. For example, the lower viscosity fluid blend can be introduced at a constant flow rate into the fracture 112, since it is believed that proppant will immediately settle out of the fluid blend.

The amount of time that a fluid blend is introduced into the fracture 112 can be determined based on the settling time of proppant out of the fluid blend when placed in the fracture 112. For example, using FIG. 2 again as example, a lower viscosity fluid can be used to deposit proppant in the fracture 112 for a first period of time until proppant fills the entire depth of the fracture 112, forming the first proppant bank 201. At that point in time, and in real-time, flow of fluid can be switched and a higher viscosity fluid can be used to deposit proppant into the fracture 112 for a second period of time until the proppant flow laterally in the fracture 112 further away from the wellbore 110 and settles to the bottom 112*a* of the fracture 112, forming the second proppant bank 202. The periods of time for lower viscosity fluid blends and higher viscosity fluid blends can continue in this manner until the fracture 112 is filled with proppant and a proppant pack 200 having a desired profile is formed.

The first proppant bank 201 that is formed by a lower viscosity fluid blend (the first fluid blend) can have a top portion 201*a* proximate to the wellbore 110, and can have a bottom portion 201*b* proximate to a bottom 112*b* of the fracture 112. The second proppant bank 202 that is formed by a higher viscosity fluid blend (the second fluid blend) can have a top portion 202*a* located in a bottom section 112*b* of the fracture 112, and can have a bottom portion 202*b* proximate to the bottom 112*a* of the fracture 112. In some embodiments, the bottom section 112*b* of the fracture 112 can be the bottom third of the fracture 112 (assuming the fracture 112 is characterized as having a top, middle, and bottom); alternatively, the bottom section 112*b* of the fracture 112 can be the bottom half of the fracture 112 (assuming the fracture 112 is characterized as having a top and a bottom). The third proppant bank 203 that is formed by a lower viscosity fluid blend (the third fluid blend) can be located above the second proppant bank 202, can be located adjacent to the first proppant bank 201, and can be located closer to the wellbore 110 than the second proppant bank 202. The fourth proppant bank 204 that is formed by a higher viscosity fluid blend (the fourth fluid blend) can have a top portion 204*a* located in the bottom section 112*b* of the fracture 112, and can have a bottom portion 204*b* proximate to the bottom 112*a* of the fracture 112. The fifth proppant bank 205 that is formed by a lower viscosity fluid blend (the fifth fluid blend) can be located above at least two of the second proppant bank 202, the third proppant bank 203, and the fourth proppant bank 204. The term "proximate" in these contexts is intended to impart relative positions. For example, a top portion 201*a* "proximate" to the wellbore 110 means the top portion 201*a* of the first proppant bank 201 is next to or close to the wellbore 110, with or without having any proppant from the top portion 201*a* actually touching the wellbore 110. In another example, the bottom portion 201*b* "proximate" to a bottom 112*b* of the fracture 112 means the bottom portion 201*b* of the first proppant bank 201 is next to or close to the bottom 112*b* of the fracture 112, with or without having any proppant from the bottom portion 201*b* of the first proppant bank 201 actually touching the bottom 112*b* of the fracture 112 (although it may touch due to gravity, there may sources of pressure such as formation fluids, or debris, that keep the proppant from touching the bottom 112*b* of the fracture 112).

In embodiments, an average distance from the wellbore 110 of proppant in the fourth proppant bank 204 is greater than an average distance from the wellbore 110 of proppant in the first proppant bank 201 and of proppant in the third proppant bank 203. In embodiments, an average distance from the wellbore of proppant in the fifth proppant bank 205 is less than an average distance from the wellbore 110 of proppant in the fourth proppant bank 204. In any given proppant bank, some proppant particles will be closer to the wellbore than others, thus the term "average distance" for the solid particles is used.

In embodiments, the viscosity of any of the first, third, and fifth fluid blends is lower than the viscosity of any of the second and fourth fluid blends. Put another way, the first, third, and fifth fluid blends can be lower viscosity fluid blends, and the second and fourth fluid blends can be higher viscosity fluid blends. In some embodiments, the viscosity of the first fluid blend is less than the viscosity of the second fluid blend, the viscosity of the third fluid blend is less than the viscosity of the second fluid blend, the viscosity of the fourth fluid blend is greater than the viscosity of the third fluid blend, and the viscosity of the fifth fluid blend is less than the viscosity of the fourth fluid blend.

In embodiments, the first, third, and fifth fluid blends can have different viscosities that all have values falling within the range of viscosities for lower viscosity fluid blends as described herein. In embodiments, two of the first, third, and fifth fluid blends can have the same viscosity while the remaining fluid blend has a different viscosity, with all three fluid blends having viscosity values falling within the range of viscosities for lower viscosity fluid blends as described herein. In embodiments, the first, third, and fifth fluid blends can have the same viscosity that is a value falling within the range of viscosities for lower viscosity fluid blends as described herein.

In embodiments, the second and fourth fluid blends can have different viscosities that all have values falling within the range of viscosities for higher viscosity fluid blends as described herein. In embodiments, the second and fourth fluid blends can have the same viscosity that is a value falling within the range of viscosities for higher viscosity fluid blends as described herein.

Various benefits are realized by the present disclosure. Switching between lower viscosity fluid blends and higher viscosity fluid blends that are designed to carry proppant for different periods of time can customize the travel depth and length of proppant into a fracture of a subterranean formation. Proppant has different settling times in the lower viscosity fluid blends and higher viscosity fluid bends; thus, an operator can observe the fracture depth and length and then customize the viscosity of the fluid blends as well as the amount of time the fluid blends are introduced into the fracture in order to fill a higher percentage of the fracture with proppant than would otherwise be accomplished with filling the fracture with a single fluid having a single viscosity. A higher percentage fill of a fracture with proppant can lead to more contact of the proppant with the reservoir and higher productivity, especially for unconventional shale-containing reservoirs.

EXAMPLES

The embodiments having been generally described, the following examples are given to demonstrate the practice and advantages thereof. It is understood that the examples are given by way of illustration and are not intended to limit the specification or the claims in any manner.

Example 1

Example 1 is a slot flow test of a slurry that is representative of the lower viscosity fluid blends disclosed herein. The slurry was made by mixing water, a viscosifying agent, and proppant. The viscosity of the slurry was 2.2 cp. The water was fresh water. The viscosifying agent was FR-76™ anionic oil-external emulsion, which is commercially available as a friction reducer from Halliburton, included an in concentration of 1 gallon/1000 gallons. The proppant was 100 mesh sand, included in a concentration of 0.120 kg/liter (1 lb/gallon) of the liquid in the slurry.

Figure 3:
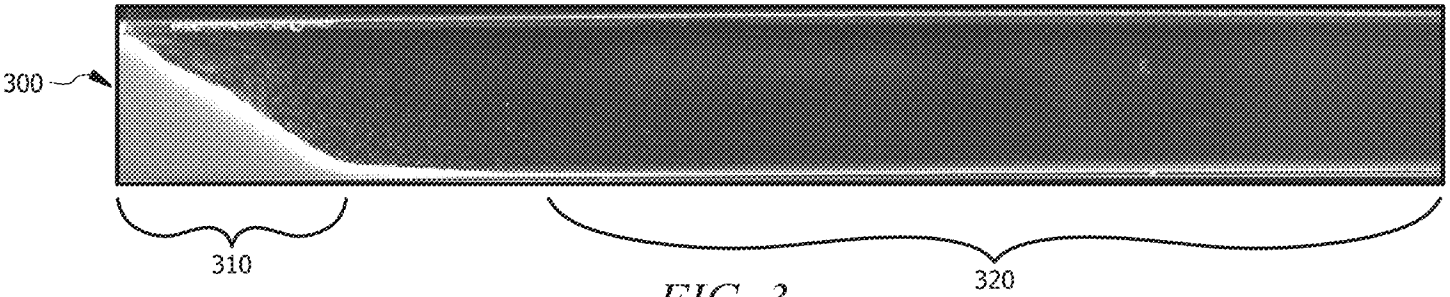
FIG. 3 is a photographic image of slot test for a lower viscosity fluid blend.

The result of the slot flow test for the lower viscosity slurry is shown in FIG. 3. To accomplish the test, the slurry was pulled through the slot (i.e., a cuboid channel that is transparent so as to observe the slurry in the slot) using a syringe pump at a rate of 60 mL/min, flowing from left to right in the image shown in FIG. 3.

As can be seen in FIG. 3, the sand 300 settled to the bottom of the slot immediately upon entering the slot from the left side. The amount of sand that settles out of the fluid decreases rapidly from left to right over a first distance 310, until a minimum amount of sand settles at a relatively steady rate as the movement of the fluid gets further from the entrance point of the slot over a second distance 320. Relatively little sand settles in the middle and right end of the slot in FIG. 3. The settling near the left side of the slot can be attributed to Stoke's law, leaving almost the entire slot without an appreciable depth of proppant.

In Example 1, the slot can be analogized to the fracture 112 that is the open space in the subterranean formation 106, and the left side of the slot in FIG. 3 can be analogized to the perforation 109 in the casing 108 that allows the fluid to enter the fracture 112. Example 1 shows that proppant in a lower viscosity fluid blend as disclosed herein begins settling out of the fluid immediately upon entering the slot due to Stoke's law, with a majority of the proppant leaving the solution close the entrance point. Proppant in a lower viscosity fluid blend disclosed herein would be expected to perform similarly in the fracture 112 of FIGS. 1 and 2.

Using only a lower viscosity fluid blend to place proppant in a fracture 112 can result in reduced effective fracture-reservoir contact, low productivity of the stimulated well or reservoir, long portions of the fracture being un-propped (without proppant), inefficient usage of the carrying fluids and chemicals.

Example 2

Example 2 is a slot flow test of another slurry that is representative of the higher viscosity fluid blends disclosed herein. The slurry was made by mixing water, a viscosifying agent, and proppant. The viscosity of the slurry was 10.9 cp. The water was fresh water. The viscosifying agent was FightR™ LX-5 polymer, which is commercially available as a friction reducer from Halliburton, included an in concentration of 1 gallon/1000 gallons. The proppant was 100 mesh sand, included in a concentration of 0.120 kg/liter (1 lb/gallon) of the liquid in the slurry.

Figure 4:
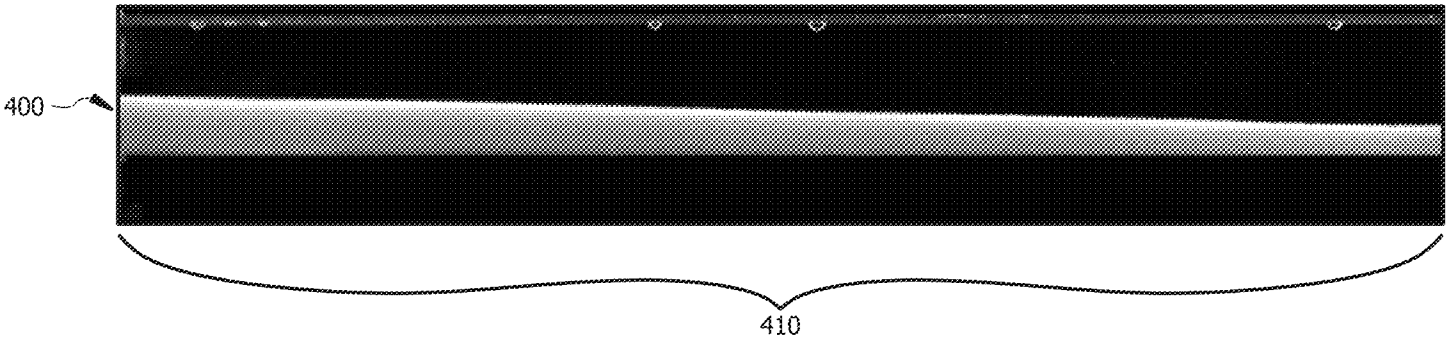
FIG. 4 is a photographic image of slot test for a higher viscosity fluid blend.

The result of the slot flow test for the higher viscosity slurry is shown in FIG. 4. To accomplish the test, the slurry was pulled through the slot (i.e., the same cuboid channel as Example 1 and for the same amount of time) using a syringe pump at a rate of 60 mL/min, flowing from left to right in the image shown in FIG. 4. As can be seen in FIG. 4, the sand 400 did not settle immediately upon entering the slot from the left side, and moreover, the slurry was able to carry the proppant over the entire length 410 of the slot from left to right. The total amount of sand in the slot of Example 2 is about the same as the amount of sand in the slot of Example 1; however, the sand is distributed more equally all the way across the length of slot in Example 2 than in Example 1.

In Example 2, the slot can again be analogized to the fracture 112 that is the open space in the subterranean formation 106, and the left side of the slot in FIG. 4 can be analogized to the perforation 109 in the casing 108 that allows the fluid to enter the fracture 112. Example 2 shows that proppant in a higher viscosity fluid blend as disclosed can be carried relatively far away from the entrance point without settling immediately out of the fluid. Proppant in a higher viscosity fluid blend disclosed herein would be expected to perform similarly in the fracture 112 of FIGS. 1 and 2.

Example 2 shows that using a higher viscosity fluid blend in sequence with a lower viscosity fluid blend to place proppant in a fracture 112 can result in increased effective fracture-reservoir contact, higher productivity of the stimulated well or reservoir, long portions of the fracture being propped (with proppant), and more efficient usage of the carrying fluids and chemicals. For example, referring to FIG. 2, the higher viscosity fluid blend used to create the proppant bank 202 can slide over and down the slope of the proppant bank 201 created using the lower viscosity fluid when entering the fracture 112. The surface of the proppant bank 201 can provide a path for flow of the higher viscosity fluid into the fracture 112, and the higher carrying capacity for proppant of the higher viscosity fluid can carry proppant further down and further along the length of the fracture 112 before the proppant settles to the bottom 112*a* of the fracture 112.

The viscosity (10.9 cp) of the fluid blend in Example 2 was 4.9 (about 5) times the viscosity (2.2 cp) of the fluid blend in Example 1, giving a ratio of about 5:1.

Additional Disclosure

The following are non-limiting, specific embodiments in accordance with the present disclosure:

Embodiment A

A method of arranging proppant in a fracture of a subterranean formation, the method comprising one or more of: (a) introducing a first fluid blend through a wellbore and into the fracture to form a first proppant bank in the fracture; (b) introducing a second fluid blend through the wellbore and into the fracture to form a second proppant bank in the fracture; (c) introducing a third fluid blend through the wellbore and into the fracture to form a third proppant bank in the fracture; (d) introducing a fourth fluid blend through the wellbore and into the fracture to form a fourth proppant bank in the fracture; or (e) introducing a fifth fluid blend through the wellbore and into the fracture to form a fifth proppant bank in the fracture.

Embodiment B

The method of Embodiment A, wherein: i) a viscosity of the first fluid blend is less than a viscosity of the second fluid blend; ii) a viscosity of the third fluid blend is less than the viscosity of the second fluid blend; iii) a viscosity of the fourth fluid blend is greater than the viscosity of the third fluid blend; iv) a viscosity of the fifth fluid blend is less than the viscosity of the fourth fluid blend; v) or a combination of i)-iv).

Embodiment C

The method of any of Embodiments A to B, wherein i) the first proppant bank has a top portion proximate to the wellbore and a bottom portion proximate to a bottom of the fracture; ii) the second proppant bank has a top portion located in a bottom section of the fracture and a bottom portion proximate to the bottom of the fracture; iii) the third proppant bank is a) located above the second proppant bank, b) adjacent to the first proppant bank, and c) closer to the wellbore than the second proppant bank; iv) the fourth proppant bank has a top portion located in the bottom section of the fracture and a bottom portion proximate to the bottom of the fracture; v) wherein the fifth proppant bank is located above at least two of the second proppant bank, the third proppant bank, and the fourth proppant bank; vi) or a combination of i)-v).

Embodiment D

The method of any of Embodiments A to C, wherein i) the first proppant bank has a top portion proximate to the wellbore and a bottom portion proximate to a bottom of the fracture; ii) the second proppant bank has a top portion located in a bottom section of the fracture and a bottom portion proximate to the bottom of the fracture; iii) the third proppant bank is a) located above the second proppant bank, b) adjacent to the first proppant bank, and c) closer to the wellbore than the second proppant bank; iv) the fourth proppant bank has a top portion located in the bottom section of the fracture and a bottom portion proximate to the bottom of the fracture; v) wherein the fifth proppant bank is located above at least two of the second proppant bank, the third proppant bank, and the fourth proppant bank; vi) or a combination of i)-v).

Embodiment E

The method of any of Embodiments A to D, wherein i) an average distance from the wellbore of proppant in the fourth proppant bank is greater than an average distance from the wellbore of proppant in the first proppant bank and of proppant in the third proppant bank; and/or ii) an average distance from the wellbore of proppant in the fifth proppant bank is less than an average distance from the wellbore of proppant in the fourth proppant bank.

Embodiment F

The method of any of Embodiments A to E, further comprising, after any of steps (a) to (e), alternating between introducing the second or fourth fluid blend and introducing the first, third, or fifth fluid blend so as to increase a size of a proppant pack containing the proppant bank(s), the fourth proppant bank, or the fifth proppant bank in the fracture, or to form a plurality of additional proppant banks in the fracture.

Embodiment G

The method of any of Embodiments A to F, wherein a flow rate of any of the fluid blends can be constant, varied, or a combination of constant and varied.

Embodiment H

The method of any of Embodiments A to G, wherein the first, second, third, fourth, or fifth fluid blend, or any combination thereof, is introduced into the fracture via a horizontal section of the wellbore.

Embodiment I

The method of Embodiments A to H, further comprising:

forming the wellbore in the subterranean formation;

forming a perforation in a casing (e.g., in a horizontal section) of the wellbore in a desired location for the fracture; and introducing a pad fluid through the perforation and into the subterranean formation to initiate the fracture in the subterranean formation.

Embodiment J

The method of any of Embodiments A to I, wherein: i) the first fluid blend comprises water, a first viscosifying agent, and proppant; ii) the second fluid blend comprises water, a second viscosifying agent, and proppant; iii) the third fluid blend comprises water, a third viscosifying agent, and proppant; iv) the fourth fluid blend comprises water, a second viscosifying agent, and proppant; v) the fifth fluid blend comprises water, a second viscosifying agent, and proppant; vi) or a combination of i)-v).

Embodiment K

The method of Embodiment J, wherein any of the first viscosifying agent, the second viscosifying agent, the third viscosifying agent, the fourth viscosifying agent, and the fifth viscosifying agent are each independently selected from a polysaccharide, a polyacrylamide, or a combination thereof.

Embodiment L

The method of any of Embodiments J to K, wherein i) the second viscosifying agent is the same as the first viscosifying agent, wherein a concentration of the first viscosifying agent in the first fluid blend is lower than a concentration of the second viscosifying agent in the second fluid blend; ii) the fourth viscosifying agent is the same as the third viscosifying agent, wherein a concentration of the third viscosifying agent in the third fluid blend is lower than a concentration of the fourth viscosifying agent in the fourth fluid blend; iii) the fifth viscosifying agent is the same as the first viscosifying agent or the third viscosifying agent, wherein a concentration of the fifth viscosifying agent in the fifth fluid blend is lower than a concentration of the fourth viscosifying agent in the fourth fluid blend; iv) the first viscosifying agent, the third viscosifying agent, and the fifth viscosifying agent are the same viscosifying agent, where a concentration of the first viscosifying agent, the third viscosifying agent, and the fifth viscosifying agent in their respective fluid blends is the same; v) the second viscosifying agent and the fourth viscosifying agent are the same viscosifying agent, wherein a concentration of the second viscosifying agent and the fourth viscosifying agent in their respective fluid blends is the same; or vi) a combination of i)-v).

Embodiment M

The method of any of Embodiments J to L, wherein the proppant in any of the first fluid blend, the second fluid blend, the third fluid blend, the fourth fluid blend, and the fifth fluid blend is independently selected from sand, resin-coated sand, glass beads, sintered bauxite, or a combination thereof.

Embodiment N

The method of any of Embodiments A to M, wherein the viscosity of any of the first fluid blend, the third fluid blend, and the fifth fluid blend is between about 1 cp and about 5 cp.

Embodiment O

The method of any of Embodiments A to N, wherein the viscosity of any of the second fluid blend and the fourth fluid blend is between about 5 cp and about 200 cp.

Embodiment P

The method of any of Embodiments A to O, wherein the fluid blends are introduced in real-time without stopping a flow of fluid to the fracture.

Embodiment Q

The method of any of Embodiments A to P, further comprising further comprising one or a combination of: after step (a) and before step (b), switching, in real-time, fluid flow into the wellbore from the first fluid blend to the second fluid blend; after step (b) and before step (c), switching, in real-time, fluid flow into the wellbore from the second fluid blend to the third fluid blend; after step (c) and before step (d), switching, in real-time, fluid flow into the wellbore from the third fluid blend to the fourth fluid blend; after step (d) and before step (e), switching, in real-time, fluid flow into the wellbore from the fourth fluid blend to the fifth fluid blend.

Embodiment R

The method of any of Embodiments A to Q, wherein the subterranean formation comprises shale.

Embodiment S

The method of any of Embodiments A to R, wherein a ratio of the viscosity of the second fluid blend or the fourth fluid blend to the viscosity of the first fluid blend, the third fluid blend, or the fifth fluid blend is in a range of from 2:1 to 200:1; alternatively, in any narrower range disclosed and/or contemplated herein.

Embodiment T

The method of any of Embodiments A to S, wherein the viscosity of the second fluid blend or the fourth fluid blend is in a range of from about 2 to 200 times the viscosity of the first fluid blend, the third fluid blend, or the fifth fluid blend; alternatively, in any narrower range disclosed and/or contemplated herein.

Embodiment U

A method of arranging proppant in a fracture of a subterranean formation, the method comprising: switching, in real-time, a continuous flow of fluids through a wellbore and into the fracture between a first fluid blend and a second fluid blend, wherein a viscosity of the first fluid blend is less than a viscosity of the second fluid blend; and building a proppant pack in the fracture as a result of the switching.

Embodiment V

The method of Embodiment U, wherein the proppant pack comprises one or more of: i) a first proppant bank having a top portion proximate to the wellbore and a bottom portion proximate to a bottom of the fracture; ii) a second proppant bank having a top portion located in a bottom section of the fracture and a bottom portion proximate to the bottom of the fracture, wherein an average distance from the wellbore of proppant in the second proppant bank is greater than an average distance from the wellbore of proppant in the first proppant bank; iii) a third proppant bank located above the second proppant bank, adjacent to the first proppant bank, and closer to the wellbore than the second proppant bank; iv) a fourth proppant bank having a top portion located in the bottom section of the fracture and a bottom portion proximate to the bottom of the fracture, wherein an average distance from the wellbore of proppant in the fourth proppant bank is greater than an average distance from the wellbore of proppant in the first proppant bank and of proppant in the third proppant bank; or v) a fifth proppant bank that is located above at least two of the second proppant bank, the third proppant bank, and the fourth proppant bank, wherein an average distance from the wellbore of proppant in the fifth proppant bank is less than an average distance from the wellbore of proppant in the fourth proppant bank.

Embodiment W

The method of any of Embodiments U to V,

Embodiment X

The method of any of Embodiments U to W, further comprising creating the first proppant bank, third proppant bank, and fifth proppant bank with one or more of: the first fluid blend, a third fluid blend, and a fifth fluid blend; and creating the second proppant bank and the fourth proppant bank with one or more of: the second fluid blend and a fourth fluid blend.

Embodiment Y

The method of any of Embodiments U to X, wherein each of the fluid blends comprises water, a viscosifying agent, and proppant; and wherein a concentration of the viscosifying agent in one or more of the first, third, and fifth fluid blends is lower than a concentration of the viscosifying agent in one or more of the second and fourth fluid blends.

Embodiment Z

The method of any of Embodiments U to Y, wherein the viscosity of any of the first, third, and fifth fluid blends is between about 1 cp and about 5 cp.

Embodiment AA

The method of any of Embodiments U to Z, wherein the viscosity of any of the second and fourth fluid blends is between about 5 cp and about 200 cp.

Embodiment BB

The method of any of Embodiments U to AA, wherein a ratio of the viscosity of the second fluid blend to the viscosity of the first fluid blend is in a range of from 2:1 to 200:1; alternatively, in any narrower range disclosed and/or contemplated herein.

Embodiment CC

The method of any of Embodiments U to BB, wherein the viscosity of the second fluid blend is in a range of from about 2 to 200 times the viscosity of the first fluid blend; alternatively, in any narrower range disclosed and/or contemplated herein.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element may be present in some embodiments and not present in other embodiments. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A method of arranging proppant in a fracture of a subterranean formation, the method comprising:

(a) introducing a first fluid blend through a wellbore and into the fracture to form a first proppant bank in the fracture; and (b) introducing a second fluid blend through the wellbore and into the fracture to form a second proppant bank in the fracture;

wherein step (a) is switched to step (b) in real-time without stopping a flow of fluid to the fracture;

wherein the first fluid blend comprises water, a first viscosifying agent, and proppant;

wherein the second fluid blend comprises water, a second viscosifying agent, and proppant; and wherein a viscosity of the first fluid blend is less than a viscosity of the second fluid blend.

2. The method of claim 1, wherein the first proppant bank has a top portion proximate to the wellbore and a bottom portion located proximate to a bottom of the fracture, wherein the second proppant bank has a top portion located in a bottom section of the fracture and a bottom portion located proximate to the bottom of the fracture, the method further comprising:

(c) introducing a third fluid blend through the wellbore and into the fracture to form a third proppant bank in the fracture, wherein the third proppant bank is i) located adjacent to the first proppant bank, ii) above the second proppant bank, and iii) closer to the wellbore than the second proppant bank, wherein a viscosity of the third fluid blend is less than the viscosity of the second fluid blend;

(d) introducing a fourth fluid blend through the wellbore and into the fracture to form a fourth proppant bank in the fracture, wherein the fourth proppant bank has a top portion located in the bottom section of the fracture and a bottom portion proximate to the bottom of the fracture, wherein an average distance from the wellbore of proppant in the fourth proppant bank is greater than an average distance from the wellbore of proppant in the first proppant bank and of proppant in the third proppant bank, wherein a viscosity of the fourth fluid blend is greater than the viscosity of the third fluid blend; and (e) introducing a fifth fluid blend through the wellbore and into the fracture to form a fifth proppant bank in the fracture, wherein the fifth proppant bank is located above at least two of the second proppant bank, the third proppant bank, and the fourth proppant bank, wherein an average distance from the wellbore of proppant in the fifth proppant bank is less than an average distance from the wellbore of proppant in the fourth proppant bank, wherein a viscosity of the fifth fluid blend is less than the viscosity of the fourth fluid blend.

3. The method of claim 2, further comprising:

after step (e), alternating between introducing the second or fourth fluid blend and introducing the first, third, or fifth fluid blend so as to increase a size of the fourth proppant bank and the fifth proppant bank in the fracture or to form a plurality of additional proppant banks in the fracture.

4. The method of claim 1, wherein a flow rate of any of the fluid blends can be constant.

5. The method of claim 1, wherein a flow rate of any of the fluid blends can be varied.

6. The method of claim 1, wherein a ratio of the viscosity of the second fluid blend to the viscosity of the first fluid blend is in a range of from 2:1 to 200:1.

7. The method of claim 1, further comprising:

introducing a pad fluid through a perforation in a casing in of the wellbore and into the subterranean formation to initiate the fracture in the subterranean formation.

8. The method of claim 7, wherein the first viscosifying agent and the second viscosifying agent are each independently selected from a polysaccharide, a polyacrylamide, or a combination thereof.

9. The method of claim 8, wherein the second viscosifying agent is the same as the first viscosifying agent, wherein a concentration of the first viscosifying agent in the first fluid blend is lower than a concentration of the second viscosifying agent in the second fluid blend.

10. The method of claim 7, wherein the proppant in each of the first fluid blend and the second fluid blend is independently selected from sand, resin-coated sand, glass beads, sintered bauxite, or a combination thereof.

11. The method of claim 1, wherein the viscosity of the first fluid blend is between about 1 cp and about 5 cp.

12. The method of claim 11, wherein the viscosity of the second fluid blend is between about 5 cp and about 200 cp.

13. The method of claim 1, wherein the subterranean formation comprises shale.

14. A method of arranging proppant in a fracture of a subterranean formation, the method comprising:

switching in real-time without stopping a continuous flow of fluids through a wellbore and into the fracture between a first fluid blend and a second fluid blend, wherein each of the first fluid blend and the second fluid blend comprises water, a viscosifying agent, and proppant, and wherein a viscosity of the first fluid blend is less than a viscosity of the second fluid blend; and building a proppant pack in the fracture as a result of the switching.

15. The method of claim 14, wherein the proppant pack comprises:

i) a first proppant bank having a top portion proximate to the wellbore and a bottom portion proximate to a bottom of the fracture;

ii) a second proppant bank having a top portion located in a bottom section of the fracture and a bottom portion proximate to the bottom of the fracture, wherein an average distance from the wellbore of proppant in the second proppant bank is greater than an average distance from the wellbore of proppant in the first proppant bank;

iii) a third proppant bank located adjacent to the first proppant bank, above the second proppant bank, and closer to the wellbore than the second proppant bank;

iv) a fourth proppant bank having a top portion located in the bottom section of the fracture and a bottom portion proximate to the bottom of the fracture, wherein an average distance from the wellbore of proppant in the fourth proppant bank is greater than an average distance from the wellbore of proppant in the first proppant bank and of proppant in the third proppant bank; or v) a fifth proppant bank that is located above at least two of the second proppant bank, the third proppant bank, and the fourth proppant bank, wherein an average distance from the wellbore of proppant in the fifth proppant bank is less than an average distance from the wellbore of proppant in the fourth proppant bank.

16. The method of claim 15, further comprising:

creating the first proppant bank, third proppant bank, and fifth proppant bank with the first fluid blend; and creating the second proppant bank and the fourth proppant bank with the second fluid blend.

17. The method of claim 14, wherein a concentration of the viscosifying agent in the first fluid blend is lower than a concentration of the viscosifying agent in the second fluid blend.

18. The method of claim 14, wherein a ratio of the viscosity of the second fluid blend to the viscosity of the first fluid blend is in a range of from 2:1 to 200:1.

* * * * *